US008956008B2

(12) United States Patent
Sasaki et al.

(10) Patent No.: US 8,956,008 B2
(45) Date of Patent: Feb. 17, 2015

(54) LIGHT-EMITTING UNIT AND LUMINAIRE

(71) Applicant: Toshiba Lighting & Technology Corporation, Kanagawa (JP)

(72) Inventors: Jun Sasaki, Kanagawa (JP); Ryotaro Matsuda, Kanagawa (JP); Yumi Hanyuda, Kanagawa (JP); Naoto Mori, Kanagawa (JP); Naoto Tokuhara, Kanagawa (JP); Takayoshi Moriyama, Kanagawa (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 82 days.

(21) Appl. No.: 13/754,573

(22) Filed: Jan. 30, 2013

(65) Prior Publication Data

US 2014/0119002 A1 May 1, 2014

(51) Int. Cl.

| | |
|---|---|
| ***F21V 5/00*** | (2006.01) |
| ***F21V 13/02*** | (2006.01) |
| ***F21V 29/00*** | (2006.01) |
| ***F21V 7/06*** | (2006.01) |
| ***F21K 99/00*** | (2010.01) |
| ***F21V 21/26*** | (2006.01) |
| *F21V 3/04* | (2006.01) |
| *F21W 121/00* | (2006.01) |
| *F21Y 101/02* | (2006.01) |

(52) U.S. Cl.

CPC ..... *F21V 13/02* (2013.01); *F21V 29/00* (2013.01); *F21V 29/246* (2013.01); *F21V 7/06* (2013.01); *F21K 99/00* (2013.01); *F21V 21/26* (2013.01); *F21V 29/22* (2013.01); *F21V 29/225* (2013.01); *F21V 3/0445* (2013.01); *F21W 2121/004* (2013.01); *F21Y 2101/02* (2013.01)

USPC ..... 362/235; 362/231; 362/296.08

(58) Field of Classification Search

CPC ..... F21V 13/02; F21V 7/06; F21V 29/22; F21V 21/26; F21K 99/00

USPC ..... 362/231, 257, 235, 296.08, 294, 287

See application file for complete search history.

(56) References Cited

U.S. PATENT DOCUMENTS

| | | | | |
|---|---|---|---|---|
| 1,955,597 | A * | 4/1934 | Lamblin-Parent | 362/235 |
| 4,286,312 | A * | 8/1981 | Benoit | 362/309 |
| 6,882,110 | B2 * | 4/2005 | Ishida et al. | 315/82 |
| 7,204,610 | B2 * | 4/2007 | Watanabe et al. | 362/235 |
| 7,682,041 | B2 * | 3/2010 | Lin | 362/231 |
| 7,736,019 | B2 * | 6/2010 | Shimada et al. | 362/244 |
| 7,806,558 | B2 * | 10/2010 | Williamson | 362/241 |

FOREIGN PATENT DOCUMENTS

| | | |
|---|---|---|
| DE | 10 2008 007723 A1 | 8/2009 |
| EP | 1 255 132 A1 | 11/2002 |

(Continued)

OTHER PUBLICATIONS

European Search Report dated Feb. 12, 2014 for Application No. 13 15 1558.

*Primary Examiner* — Anabel Ton

(74) *Attorney, Agent, or Firm* — Ulmer & Berne LLP

(57) ABSTRACT

According to one embodiment, a light-emitting unit includes a light-emitting section, a diffusion cover, and a reflector. The light-emitting section includes an LED element. The diffusion cover diffuses light emitted from the light-emitting section. The reflector controls the light diffused by the diffusion cover.

13 Claims, 5 Drawing Sheets

(56) References Cited

FOREIGN PATENT DOCUMENTS

| | | | |
|---|---|---|---|
| EP | 2 354 641 | A2 | 8/2011 |
| GB | 2 464 919 | A | 5/2010 |
| JP | 2008 270096 | A | 11/2008 |
| JP | 2012-009280 | | 1/2012 |
| WO | 2005/013365 | A2 | 2/2005 |
| WO | 2012/063842 | A1 | 5/2012 |

* cited by examiner (a)

(b)

LIGHT-EMITTING UNIT AND LUMINAIRE

INCORPORATION BY REFERENCE

The present invention claims priority under 35 U.S.C. §119 to Japanese Patent Application No. 2012-241118 filed on Oct. 31, 2012. The content of the application is incorporated herein by reference in their entirety.

FIELD

Embodiments described herein relate generally to light-emitting unit used as, for example, a floodlight and a luminaire including the light-emitting unit.

BACKGROUND

There has been a high-power luminaire used as a floodlight, a spotlight, or the like for lighting a signboard or the like or illuminating a building. As such a luminaire, in recent years, there has been known a luminaire including an LED (a light-emitting diode), which functions as a solid-state light-emitting element, as a luminous element for the purpose of an extension of life, energy saving, a reduction in weight, a reduction in size, or the like.

BRIEF DESCRIPTION OF THE DRAWINGS

FIG. 4(*b*) is a diagram of a luminous intensity distribution of a comparative example in which a diffuser is arranged halfway up in a second optical system instead of the first optical system;

FIG. 5(*b*) is a diagram of a brightness distribution of a light-emitting unit of a comparative example not including the first optical system;

FIG. 7(*b*) is a diagram of a luminous intensity distribution of a light-emitting unit of a comparative example not including the first optical system;

FIG. 8(*b*) is an explanatory diagram showing, in a gray-scale, pseudo color display of a plane 1000 mm ahead by a light-emitting unit of a comparative example not including the first optical system.

DETAILED DESCRIPTION

In general, according to one embodiment, a light-emitting unit includes a light-emitting section, a first optical system, and a second optical system. The light-emitting section includes a solid-state light-emitting element. The first optical system diffuses light emitted from the light-emitting section. The second optical system controls a luminous intensity distribution of the light diffused by the first optical system.

Figure 1:
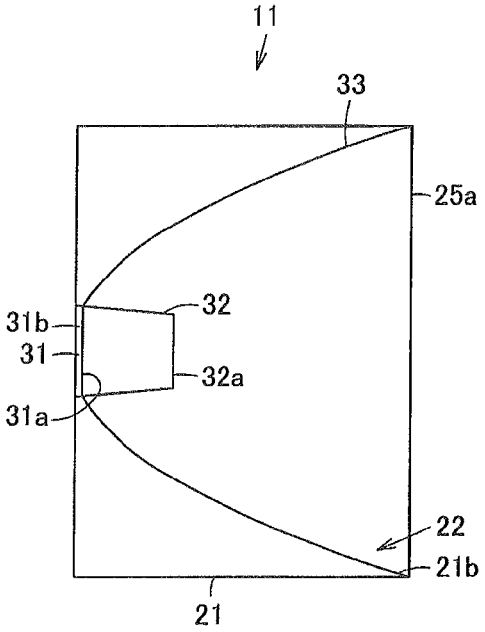
FIG. 1 is a sectional view schematically showing a part of a light-emitting unit according to a first embodiment.
Figure 2:
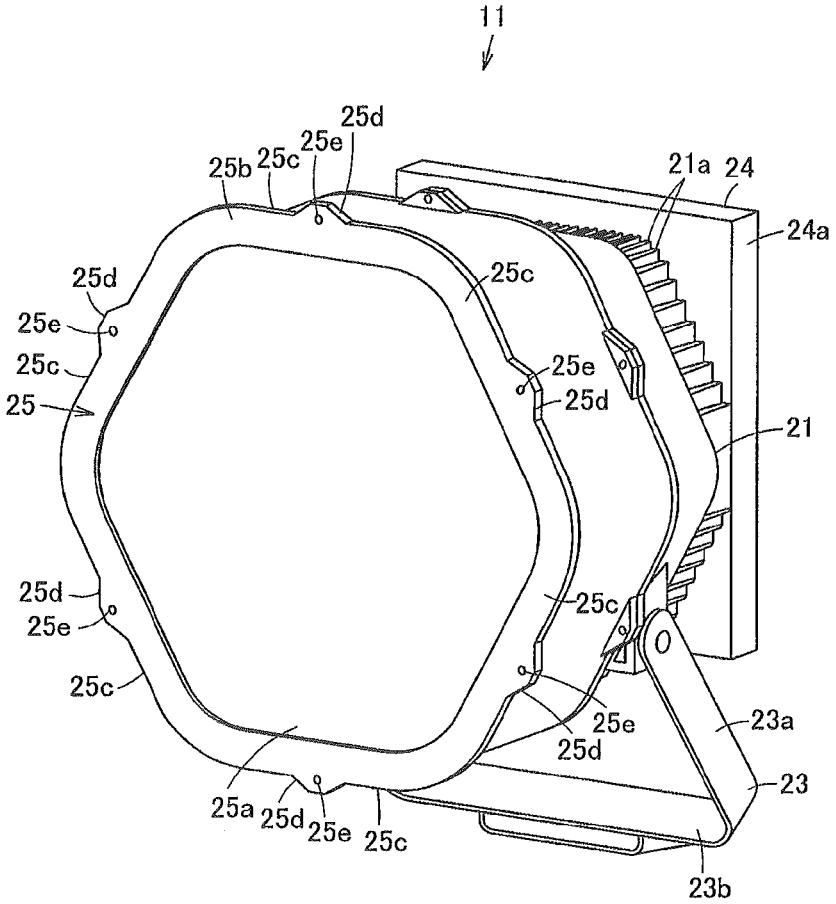
FIG. 2 is a perspective view of a luminaire including the light-emitting unit.

A configuration of a first embodiment is explained below with reference to FIG. 1 to FIGS. 5(*a*) and 5(*b*). In FIGS. 1 and 2, reference numeral 11 denotes a floodlight functioning as a luminaire. The floodlight 11 irradiates light on an irradiation target such as various signboards or a building. In the following explanation, it is assumed that the front back direction is set with reference to an optical axis direction (an irradiating direction).

The floodlight 11 includes a housing 21 functioning as a luminaire main body, a light-emitting unit 22 arranged in the housing 21, an attachment arm 23 functioning as an attachment member that attaches the housing 21 to a not-shown attachment section of a structure or the like, a power supply section 24 that supplies electric power to a light-emitting section 31, and a cover section 25 attached to the housing 21.

The housing 21 is a thermal radiator formed in, for example, a bottomed hexagonal cylindrical shape by a light-weight member excellent in heat radiation properties such as aluminum or die-cast aluminum. On the back side of a bottom surface section of the housing 21, a large number of radiation fins 21*a* functioning as thermal radiation sections are protrudingly provided. Further, the front end of the housing 21 is formed as an emission opening 21*b* from which light is emitted. The emission opening 21*b* is covered by the cover section 25. In a circumferential edge portion at the front end of the housing 21, a not-shown plurality of attachment seats for attaching and fixing the cover section 25 are protrudingly provided. In the attachment seats, screw holes for screwing and fixing not-shown screws or the like, which are fixing bodies, for fixing the cover section 25 are respectively opened.

The radiation fins 21*a* are continuously formed in a longitudinal shape on the back of the entire bottom surface section of the housing 21 along, for example, the up down direction, i.e., a direction crossing (orthogonal to) the optical axis direction. The radiation fins 21*a* are spaced apart from one another in the width direction at a predetermined interval (e.g., an interval of about 6 to 10 mm).

The light-emitting unit 22 includes the light-emitting section 31, a diffusion cover 32 functioning as a first optical system detachably attached to the housing 21 to cover the light-emitting section 31, and a reflector 33 functioning as a second optical system attached to the housing 21 to cover the light-emitting section 31 and the diffusion cover 32.

In the light-emitting section 31, for example, an LED element 31*a* functioning as a solid-state light-emitting element (a semiconductor light-emitting element) is used as a light source. In this embodiment, a COB (Chip On Board) system for mounting a plurality of LED elements 31*a* on a circular substrate 31*b* is adopted. Specifically, in the light-emitting section 31, the plurality of LED elements 31*a* mounted on the substrate 31*b* are electrically connected in series by wire bonding. The plurality of LED elements 31*a* are integrally covered and sealed by a phosphor layer made of transparent resin such as silicone resin mixed with a phosphor. In this embodiment, the light-emitting section 31 is configured to emit white light by covering the LED element 31*a*, which emits, for example, blue light, with a phosphor layer mixed with a yellow phosphor.

Figure 3:
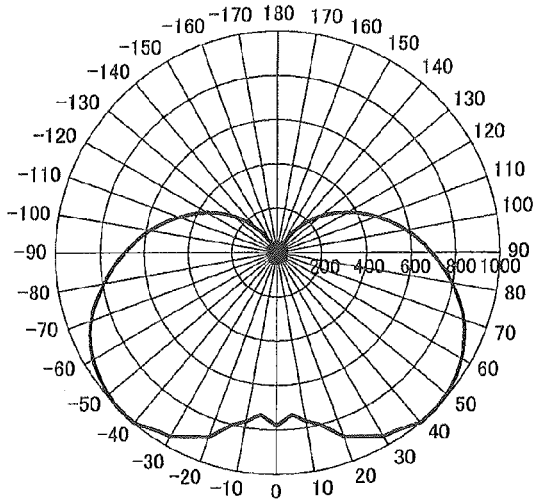
FIG. 3 is a diagram of a luminous intensity distribution by a first optical system of the light-emitting unit.

The diffusion cover 32 is a diffusion member that diffuses light from the light-emitting section 31, i.e., distributes the light at a wide angle. The diffusion cover 32 is detachably arranged on the inside of the reflector 33 to cover the light-emitting section 31. Therefore, the diffusion cover 32 is formed smaller than the reflector 33. The diffusion cover 32 is formed in, for example, a bottomed cylindrical shape by a member made of synthetic resin or the like having translucency and diffusibility. The diffusion cover 32 is shaped to be gradually reduced in diameter from the rear side, which is the light-emitting section 31 side, to the front side. In other words, the diffusion cover 32 is formed in a substantially trapezoidal shape viewed from aside with respect to the optical axis direction. The diffusion cover 32 is arranged such that the center axis thereof coincides with the center of the light-emitting section 31. A luminous intensity distribution of the diffusion cover 32 is controlled according to the height, i.e., the front back direction (axis direction) dimension, the diameter dimension, and the thickness of the diffusion cover 32. The diffusion cover 32 is set to thickness of, for example, 1.0 mm. The diffusion cover 32 has a luminous intensity distribution not having maximum luminous intensity in the optical axis direction (the 0° direction), in other words, having maximum luminous intensity in directions (in this embodiment, for example, ±50° directions) different from the optical axis direction and having a ½ beam angle set to a ½ beam angle larger than 120°, in this embodiment, set to a ½ beam angle of, for example, about 220° (FIG. 3).

The reflector 33 is formed in a cylindrical shape opened at both the front and rear ends and is formed in a paraboloid shape expanded in diameter from the rear side to the front side. The inner surface, i.e., a reflection surface of the reflector 33 is formed in a mirror surface shape. Further, the reflector 33 is fixed to the housing 21 by, for example, screwing to have an optical axis along a direction substantially orthogonal to the surface direction of the bottom surface section thereof. The reflector 33 is configured to condense (control) the light diffused (distributed at a wide angle) by the diffusion cover 32 such that the ½ beam angle is smaller than 120°, in this embodiment, for example, about 30° and irradiate the light from the emission opening 21*b* (via the cover section 25) (FIG. 4 (*a*)). The center of a front end 32*a* of the diffusion cover 32 is located in the vicinity of the focal point of the reflector 33.

The attachment arm 23 is a member for attaching and fixing the floodlight 11 to a predetermined attachment position at a predetermined angle. The attachment arm 23 is integrally formed by a member having rigidity made of metal or the like. The attachment arm 23 is formed in a U shape including a pair of arms 23*a* pivotably connected to both the sides of the housing 21 and a coupling section 23*b* that couples the arms 23*a* and is attached pivotably with respect to the attachment position. The housing 21 is axially supported to be pivotable in the up down direction with respect to the attachment arm 23. The attachment arm 23 is attached pivotably in the left right direction with respect to the attachment position. Consequently, the floodlight 11 is pivotable in the up down direction and the left right direction.

The power supply section 24 is configured in a unit shape with a not-shown plurality of power supplies arranged in a matrix shape in a case body 24*a* having, for example, a square shape. The power supply section 24 is configured to supply predetermined direct-current electric power to the light-emitting section 31.

The cover section 25 includes a cover 25*a* functioning as a cover section main body formed in, for example, a hexagonal plate shape by a member made of glass or the like having translucency and a frame body 25*b* having a hexagonal frame shape that holds the outer edge of the cover 25*a*. The cover 25*a* is attached to cover the front end of the housing 21. The frame body 25*b* is fit in the front end of the housing 21 to cover the outer edge of the cover 25*a* in a picture frame shape. The frame body 25*b* includes attachment piece sections 25*d* that project in a flange shape from the centers of side sections 25*c* to the sides. In the attachment piece sections 25*d*, through-holes 25*e* aligned with screw holes of the attachment seats of the housing 21 are opened. Screws or the like are inserted into the screw holes through the through-holes 25*e*.

The floodlight 11 is fixed by attaching the attachment arm 23 to the attachment position with bolts or the like and adjusting pivoting angles in the up down direction and the left right direction according to a positional relation between the irradiation target and the attachment position.

In this state, when the light-emitting section 31 supplied with electric power from the power supply section 24 emits light, distributed light from the light-emitting section 31 is diffused (distributed at a wide angle) by the diffusion cover 32, then reflected on the inner surface of the reflector 33 and subjected to condensing control, and transmitted through and emitted from the cover 25*a* to light the irradiation target.

As explained above, according to the first embodiment, the light from the light-emitting section 31 is diffused (distributed at a wide angle) by the diffusion cover 32 to control the luminous intensity distribution of the diffused light with the reflector 33 (condense and irradiate the light distributed at a wide angle with the reflector 33) while reducing glare by preventing intense light from scattering in a direction parallel to an irradiation direction. Consequently, it is possible to easily light only the inside of a desired range. In other words, if emitted light is diffused by a diffuser, it is not easy to surely control luminous intensity distribution through design. Therefore, in this embodiment, the light once diffused (distributed at a wide angle) by the diffusion cover 32 to reduce glare is controlled (condensed) by the reflector 33. Consequently, it is possible to easily control an irradiation range of the light with reduced glare.

Further, the diffusion cover 32 has the luminous intensity distribution not having maximum luminous intensity in the optical axis direction and having the ½ beam angle larger than 120°. The reflector 33 condenses the light such that the ½ beam angle is smaller than 120°. Consequently, it is possible to more surely irradiate only the inside of the desired range while more surely reducing glare.

Figure 4:
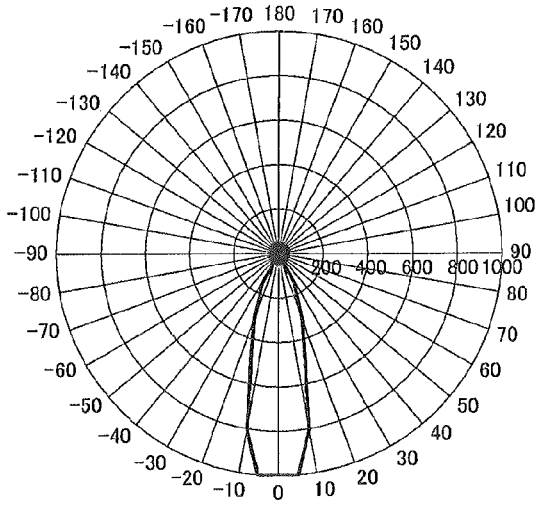
FIG. 4(*a*) is a diagram of a luminous intensity distribution of the light-emitting unit.
Figure 4:
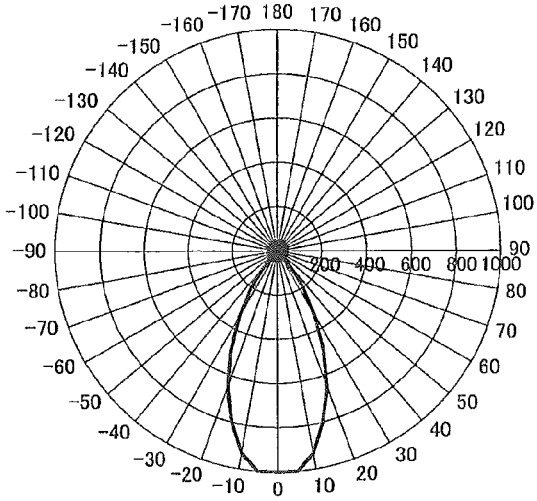

Specifically, a ray is narrowed in the luminous intensity distribution of the light emitted from the floodlight 11 according to this embodiment (FIG. 4(*a*)) compared with a luminous intensity distribution in a comparative example (FIG. 4(*b*)) in which a diffuser is arranged, for example, between both the front and rear ends of (halfway up in) the reflector 33. Therefore, it is seen that it is easy to light the inside of the desired range.

Figure 5:
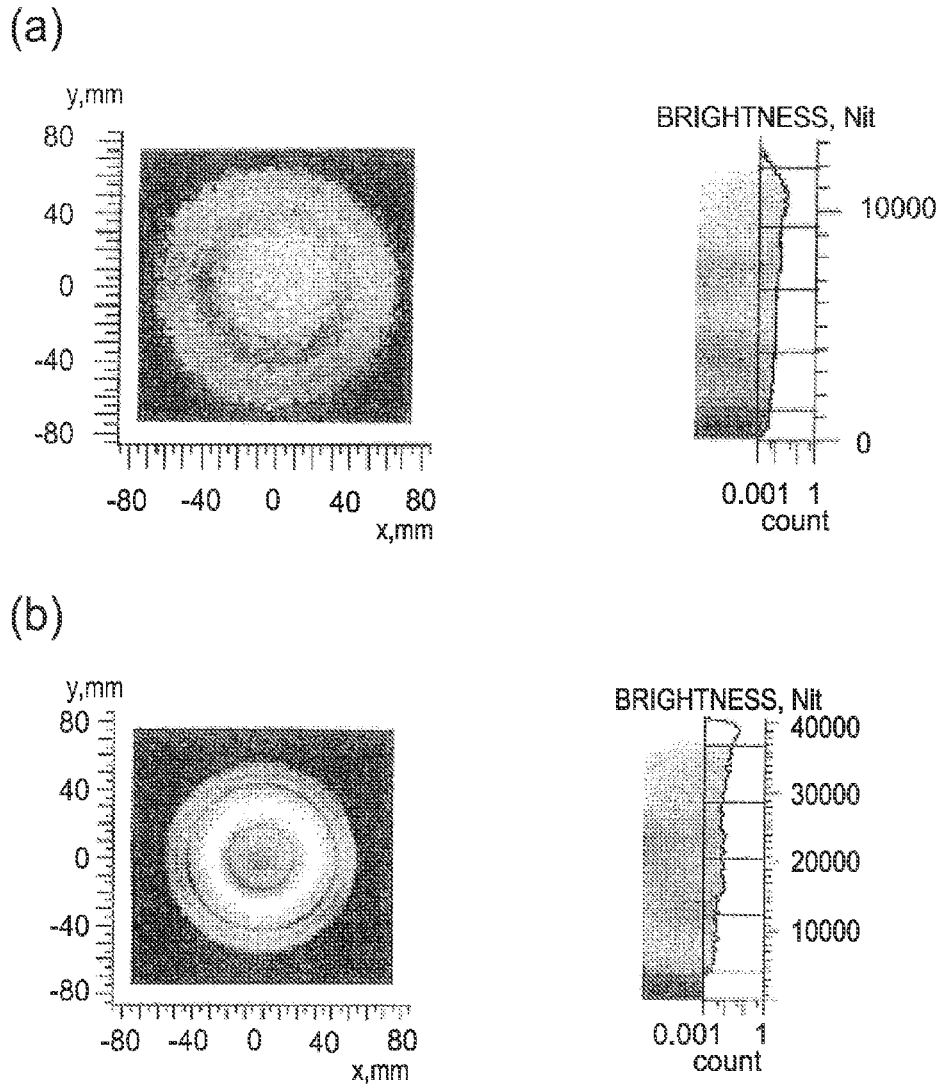
FIG. 5(*a*) is a diagram of a brightness distribution of the light-emitting unit.

In a brightness distribution of a comparative example in which a light-emitting unit has a total luminous flux and a luminous intensity distribution substantially equal to those in this embodiment and does not include the diffusion cover 32 (FIG. 5(*b*)), an absolute value of brightness is large and a uniformity ratio of brightness is not achieved. On the other hand, in a brightness distribution in this embodiment (FIG. 5(*a*)), a uniformity ratio of brightness is relatively high and an absolute value of brightness is low. Therefore, it is seen that glare is reduced.

Figure 6:
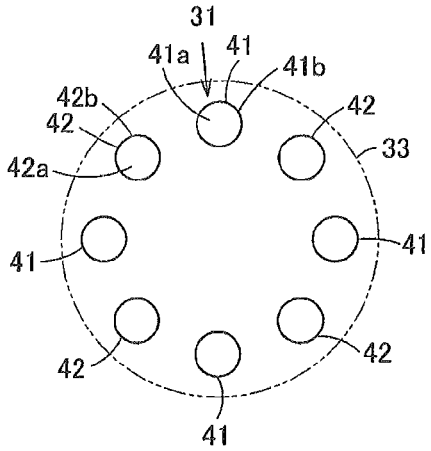
FIG. 6 is a plan view schematically showing a light-emitting section of a light-emitting unit according to a second embodiment.

A second embodiment is explained with reference to FIGS. 6 to 8. Components and action same as those in the first embodiment are denoted by the same reference numerals and signs and explanation of the components and the action is omitted.

In the floodlight 11 according to the second embodiment, at least two kinds of light-emitting sections having light emission wavelengths different from each other, i.e., two kinds of (first and second) light-emitting sections 41 and 42 are set as the light-emitting section 31.

The light-emitting section 41 emits white light. In the light-emitting section 41, for example, a plurality of LED elements 41*a* that emit blue light are mounted on a circular substrate 41*b* and electrically connected in series by wire bonding. The plurality of LED elements 41*a* are integrally covered and sealed by a phosphor layer made of transparent resin such as silicone resin mixed with a yellow phosphor.

The light-emitting section 42 emits red light. The light-emitting section 42 is used to improve a color rendering property of emitted light from the floodlight 11. Specifically, the light-emitting section 42 has a light emission spectrum distribution showing maximum intensity in a wavelength region of 600 to 650 nm. In the light-emitting section 42, for example, a plurality of LED elements 42*a* that emit red light are mounted on a circular substrate 42*b* and electrically connected in series by wire bonding.

The light-emitting sections 41 and 42 are, for example, alternately arranged to be spaced apart from each other in the circumferential direction on the same circumference. Overall, a plurality of light-emitting sections 41 and a plurality of light-emitting sections 42, for example, four light-emitting sections 41 and four light-emitting sections 42 are provided.

The diffusion cover 32 and the reflector 33 are attached to the light-emitting section 31. Specifically, the diffusion cover 32 is attached to the housing 21 to cover the entire light-emitting sections 41 and 42. The reflector 33 is attached to the housing 21 to include the diffusion cover 32.

Figure 7:
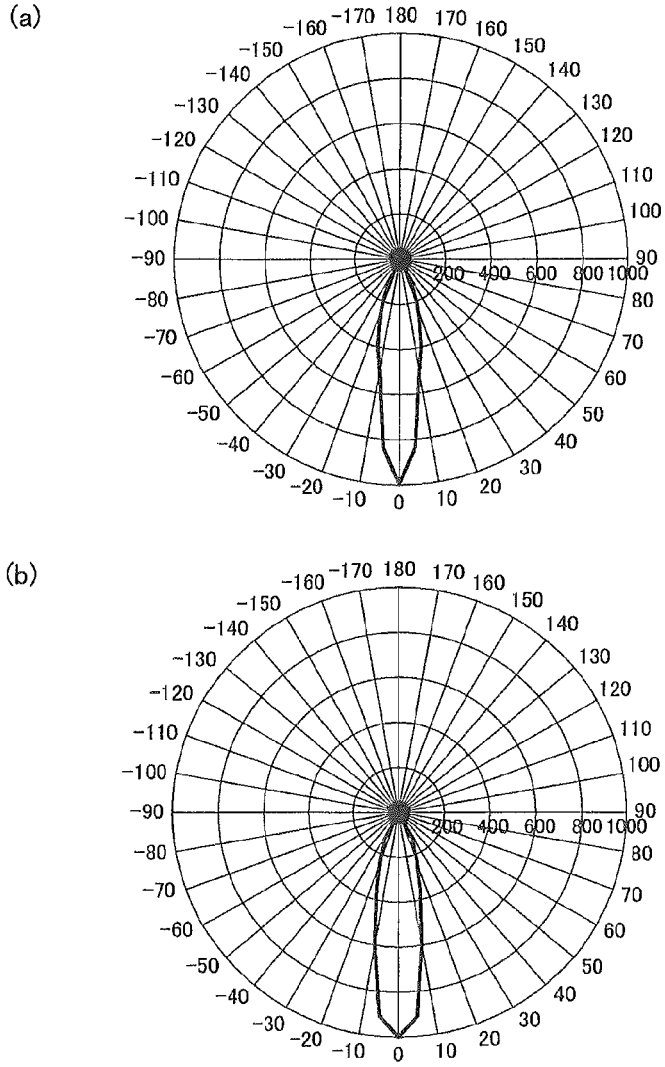
FIG. 7(*a*) is a diagram of a luminous intensity distribution of the light-emitting unit.
Figure 8:
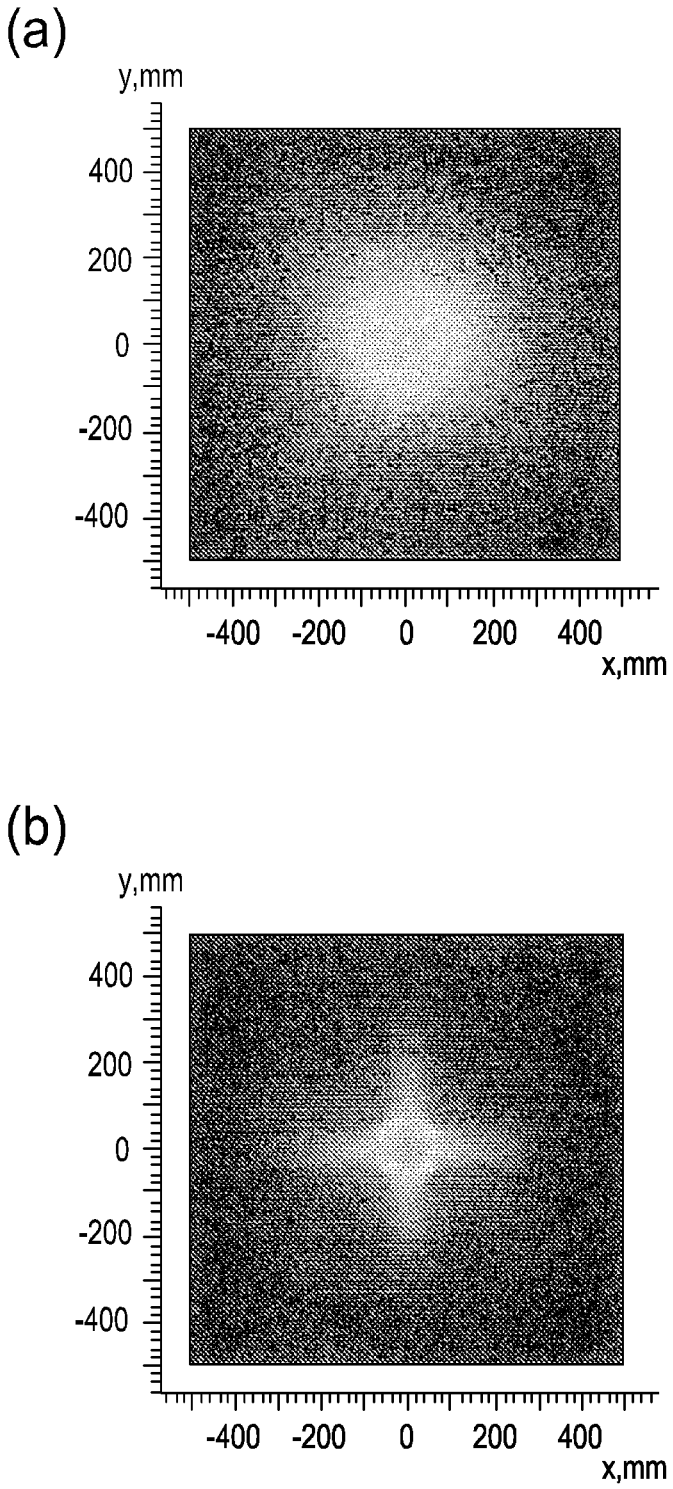
FIG. 8(*a*) is an explanatory diagram showing, in a gray-scale, pseudo color display of a plane 1000 mm ahead by the light-emitting unit.

The reflector 33 is configured to condense (control) light diffused (distributed at a wide angle) by the diffusion cover 32 such that a ½ beam angle is smaller than 120°, in this embodiment, for example, about 20° and irradiate the light from the emission opening 21*b* (via the cover section 25) (FIG. 7(*a*)).

In the floodlight 11 attached and fixed to the attachment position at a predetermined pivoting angle by the attachment arm 23, when the light-emitting sections 41 and 42 set as the light-emitting section 31 and supplied with electric power from the power supply section 24 emit lights, distributed lights from the light-emitting sections 41 and 42 are diffused (distributed at a wide angle) by the diffusion cover 32 and mixed (mixed in colors), then reflected on the inner surface of the reflector 33 and subjected to condensing control, and transmitted through and emitted from the cover 25*a* to light an irradiation target.

As explained above, according to the second embodiment, the light from the light-emitting section 31 is diffused (distributed at a wide angle) by the diffusion cover 32 to control the luminous intensity distribution of the diffused light with the reflector 33 (condense and irradiate the light distributed at a wide angle with the reflector 33) while reducing glare by preventing intense light from scattering in a direction parallel to an irradiation direction. Consequently, it is possible to easily light only the inside of a desired range.

If the two kinds of light-emitting sections 41 and 42 having the light emission wavelengths different from each other are set as the light-emitting section 31, it is likely that color unevenness occurs on an irradiated surface. In particular, if a reflector is used to make a beam angle relatively narrow in a high-power luminaire, it is not easy to reduce the color unevenness using the reflector. However, in this embodiment, the emitted lights from the light-emitting sections 41 and 42 are mixed when being diffused (distributed at a wide angle) by the diffusion cover 32 and subjected to luminous intensity distribution control (condensed) by the reflector 33. Therefore, it is possible to make it less likely that color unevenness occurs on the irradiated surface while lighting only the inside of the desired range.

In particular, in the light-emitting section 41 in which the LED elements 41*a* that emit blue light and a phosphor layer including a yellow phosphor are combined, white light emitted from the light-emitting section 41 has a low color rendering property. However, red light emitted from the light-emitting section 42 can be mixed with the white light without causing color unevenness. Therefore, it is possible to improve the color rendering property while reducing glare.

Specifically, for example, in a comparative example in which a light-emitting unit does not include the diffusion cover 32, a luminous intensity distribution (FIG. 7(*b*)) is equal to a luminous intensity distribution (FIG. 7(*a*)) of the light emitted from the floodlight 11 according to this embodiment. However, color unevenness conspicuously occurs on the irradiated surface (FIG. 8(*b*)). On the other hand, in the light irradiated from the floodlight 11 according to this embodiment, color mixture can be sufficiently realized on the irradiated surface. It is seen that the light is irradiated without color unevenness (FIG. 8(*a*)).

In the second embodiment, if the light-emitting sections 41 and 42 are configured to have light emission wavelengths different from each other, in other words, have light emission colors different from each other, the light-emitting sections 41 and 42 are not limited to a combination of white and red.

Three or more light-emitting sections having light emission wavelengths different from one another may be used.

Further, in the embodiments, the light-emitting unit 22 can be applied to not only the floodlight 11 but also any luminaire.

If the diffusion cover 32 is set to have a luminous intensity distribution not having maximum luminous intensity in the optical axis direction and having the ½ beam angle larger than 120°, the diffusion cover 32 is not limited to the luminous intensity distributions in the embodiments.

Similarly, if the reflector 33 can condense and irradiate light such that the ½ beam angle is smaller than 120°, the reflector 33 is not limited to the luminous intensity distributions in the embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A light-emitting unit comprising:

a light-emitting section including a solid-state light-emitting element;

a first optical system configured to diffuse light emitted from the light-emitting section; and a second optical system configured to condense the light diffused by the first optical system, wherein a luminous intensity distribution of the light diffused by the first optical system does not have a maximum luminous intensity along an optical axis direction of the first optical system and a ½ beam angle of the light diffused by the first optical system is larger than 120°, and a ½ beam angle of the light condensed by the second optical system is smaller than 120°.

2. The light-emitting unit according to claim 1, wherein the first optical system includes a diffuser which is shaped to be gradually reduced in cross-section from a side of the light-emitting section to a side of the second optical system.

3. The light-emitting unit according to claim 1, wherein the second optical system is a reflector, a reflection surface of which is formed in a parabolic shape.

4. The light-emitting unit according to claim 1, wherein the light-emitting section includes light-emitting units for emitting light having wavelengths different from each other.

5. The light-emitting unit according to claim 4, wherein one of the light-emitting units exhibit a light emission spectrum distribution showing maximum intensity in a wavelength region of 600 to 650 nm.

6. The light-emitting unit according to claim 1, wherein the solid-state light-emitting element is an LED element.

7. A luminaire comprising:

a light-emitting section including a solid-state light-emitting element;

a first optical system configured to diffuse light emitted from the light-emitting section;

a second optical system configured to condense the light diffused by the first optical system; and a main body in which the light-emitting section, the first optical system, and the second optical system are arranged, wherein a luminous intensity distribution of the light diffused by the first optical system does not have a maximum luminous intensity along an optical axis direction of the first optical system and a ½ beam angle of the light diffused by the first optical system is larger than 120°, and a 112 beam angle of the light condensed by the second optical system is smaller than 120°.

8. The luminaire according to claim 7, further comprising an attachment arm attached to the main body and movable with respect to the main body to position the main body at a predetermined angle.

9. A method of controlling a distribution of light emitted from one or more solid-state light-emitting elements installed in a luminaire having a diffuser and a reflector, comprising: diffusing the light emitted from the solid-state light-emitting elements with the diffuser, such that a luminous intensity distribution the light diffused by the diffuser does not have a maximum luminous intensity along an optical axis direction of the diffuser and a ½ beam angle of the light diffused by diffuser is larger than 120°; and condensing the light diffused by diffuser with the reflector, such that a ½ beam angle of the light condensed by the reflector is smaller than 120°.

10. The method of claim 9, wherein the diffuser is shaped to be gradually reduced in cross-section from a side of the solid-state light-emitting elements to a side of the reflector.

11. The method of claim 10, wherein the reflector has a reflection surface which is formed in a parabolic shape.

12. The method of claim 9, wherein the light-emitting elements are arranged in a circular manner and to be evenly spaced apart from each other.

13. The luminaire according to claim 7, wherein the main body is configured to radiate heat from the light-emitting section.

* * * * *